US006289940B1

(12) United States Patent
Herring

(10) Patent No.: US 6,289,940 B1
(45) Date of Patent: Sep. 18, 2001

(54) PAPERMAKING FABRIC SEAM WITH ADDITIONAL THREADS IN THE SEAM AREA

(75) Inventor: Samuel H. Herring, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/384,320

(22) Filed: Aug. 27, 1999

Related U.S. Application Data

(60) Provisional application No. 60/098,547, filed on Aug. 31, 1998, provisional application No. 60/097,831, filed on Aug. 31, 1998, provisional application No. 60/098,566, filed on Aug. 31, 1998, provisional application No. 60/098,567, filed on Aug. 31, 1998, and provisional application No. 60/098, 573, filed on Aug. 31, 1998.

(51) Int. Cl.[7] ..... D03D 13/00; D21F 1/00; D21F 7/10

(52) U.S. Cl. ..... 139/383 AA; 442/270; 428/58; 428/193

(58) Field of Search ..... 139/383 AA; 442/270; 428/58, 193; 162/904

(56) References Cited

U.S. PATENT DOCUMENTS

| | | | | |
|---|---|---|---|---|
| 3,316,599 | | 5/1967 | Wagner . | |
| 4,186,780 | | 2/1980 | Josef et al. . | |
| 4,438,789 | | 3/1984 | MacBean | 139/383 A |
| 4,601,785 | | 7/1986 | Lilja et al. . | |
| 4,842,925 | | 6/1989 | Dufour et al. . | |
| 4,979,543 | | 12/1990 | Moriarty et al. . | |
| 5,188,884 | | 2/1993 | Smith . | |
| 5,458,161 | | 10/1995 | Scarfe . | |
| 5,476,123 | | 12/1995 | Rydin . | |
| 5,531,251 | | 7/1996 | Rydin . | |
| 5,799,709 | | 9/1998 | Shipley . | |
| 5,904,187 | * | 6/2000 | Davenport | 139/383 AA |
| 5,913,339 | | 6/1999 | Lee . | |
| 6,079,454 | * | 6/2000 | Lee et al. | 139/383 AA |

* cited by examiner

*Primary Examiner*—Andy Falik
(74) *Attorney, Agent, or Firm*—Volpe & Koenig, PC

(57) ABSTRACT

An open ended papermaker's fabric woven from longitudinal and transverse thread systems and including a plurality of seam loops at each end. Two additional transverse threads are interwoven with the longitudinal thread system in the seam zone. The crossover points of the two additional transverse threads occur at a transition between paired paper and machine side threads of the longitudinal thread system which are separated in the transverse direction by at least three top layer longitudinal threads.

21 Claims, 7 Drawing Sheets

PAPERMAKING FABRIC SEAM WITH ADDITIONAL THREADS IN THE SEAM AREA

This application claims the benefit of: U.S. Provisional Application Serial No. 60/098,547, filed Aug. 31, 1998; U.S. Provisional Application Serial No. 60/097,831, filed Aug. 31, 1998; U.S. Provisional Application Serial No. 60/098,566, filed Aug. 31, 1998; U.S. Provisional Application Serial No. 60/098,567, filed Aug. 31, 1998; and U.S. Provisional Application Serial No. 60/098,573, filed Aug. 31, 1998.

BACKGROUND

The present invention generally relates to an open ended, woven fabric which is designed for use in a papermaking, cellulose or board manufacturing machine. The fabric has a plurality of loops at each end to form a seam for rendering the fabric endless.

As will be known to those skilled in the art, papermaking machines generally include three sections commonly referred to as the forming, press and dryer sections. The present invention finds particular application in the press section of a papermaking machine.

Typically, press felts include a supporting base, such as a woven fabric, and a paper carrying or supporting layer. Frequently, the paper support layer is a homogeneous, non-woven batt that has been affixed to the base. Base fabrics are typically woven fabrics which are used as an endless loop. Such an endless loop fabric may be woven endless with no seam or the fabric may be woven with two ends which are joined by a seam. Typical seams include pin type seams which utilize a pintle inserted through seam loops to close the fabric.

Some prior art seams have employed threads in the seam area to increase batt adhesion. However, these efforts have not always produced the desired contact area or the desired interconnection between paper and machine side machine direction threads.

As a result, there exists a need in seam loop construction to provide increased surface contact in the seam zone for better batt anchorage and a better interconnection between the paper and machine sides.

SUMMARY

The present invention relates to an open ended papermaker's fabric of a type woven from a longitudinal thread system and a transverse thread system. A plurality of seam loops are formed at each end of the fabric by the threads of the longitudinal thread system. A seam zone exists at each end of the fabric between the respective seam loops and the last thread of the transverse thread system. At least one, but preferably two, additional transverse threads are interwoven in at least one seam zone with the longitudinal thread system. The additional threads may be woven in a repeat pattern that includes at least twelve adjacent paper side longitudinal threads, at least one machine side interlacing and a portion that weaves continuously with at least five adjacent paper side longitudinal threads. The continuous weave portion may include at least to identical subrepeats.

DESCRIPTION OF THE PREFERRED EMBODIMENTS

Figure 1:
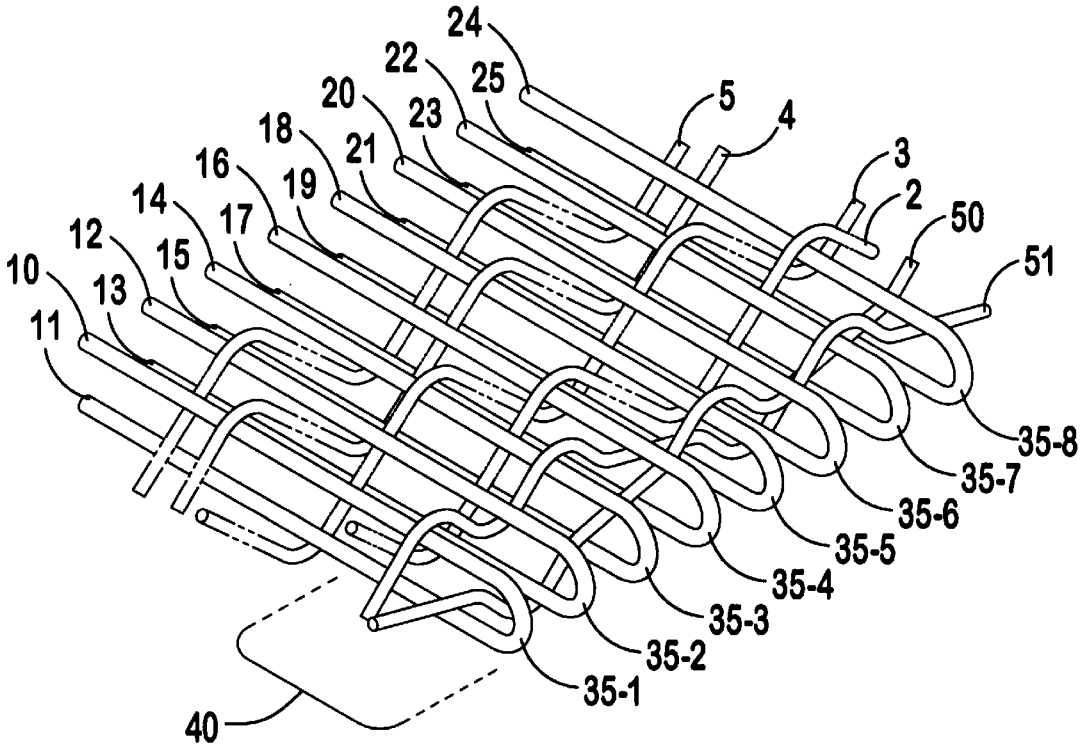
FIG. 1 shows a portion of the longitudinal seam loops in a fabric having additional cross machine direction threads in accordance with the present invention.
Figure 2:
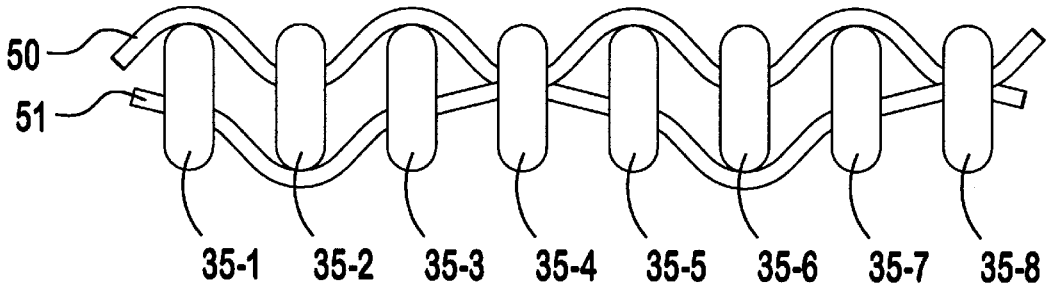
FIG. 2 is a front elevation of the seam loops and additional threads shown in FIG. 1.

The preferred embodiments will be described with reference to the drawing figures wherein like numerals represent like elements throughout.

Referring to FIG. 1, it shows a portion of the base fabric seam loops with additional threads woven in accordance with the present invention. The base fabric 1 comprises a top layer of MD threads, 10, 12, 14, 16, 18, 20, 22, and 24, and a bottom layer of MD threads, 11, 13, 15, 17, 19, 21, 23 and 25. It will be understood that the top and bottom layers are essentially continuous threads which form the seam loops 35-1 to 35-8 between the top and bottom layers. Typically, the phantom CM threads 2–5 are interwoven with the top and bottom MD thread layers in a given repeat pattern to form the body of the fabric. The body of the fabric forms no part of the present invention. A seam zone 40 exists between the end CMD thread 2 and the seam loops 35-1 to 35-8.

Figure 3:
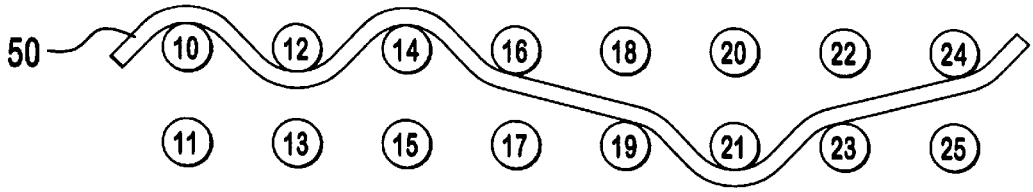
FIG. 3 illustrates one weave repeat pattern for one of the additional threads.
Figure 4:
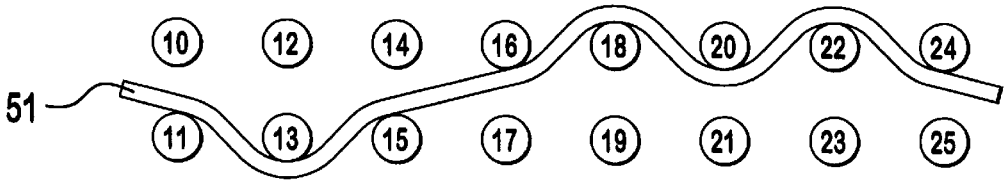
FIG. 4 illustrates one weave repeat for a second additional thread.
Figure 5:
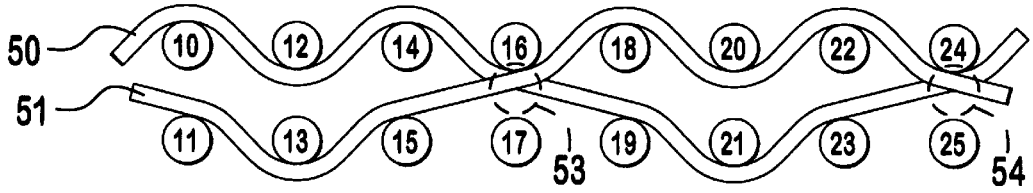
FIG. 5 shows the weave repeats of FIGS. 3 and 4 combined but without the seam loops as shown in FIG. 2.

Reference is now made to FIGS. 3, 4 and 5. Although some benefits will be obtained with a single thread, in the preferred embodiment two additional threads are used for more uniformity in the paper side surface. The two additional CMD threads 50 and 51 are interwoven in the seam zone 40 with both layers of MD threads 10 through 25. Additional CMD thread 50 preferably weaves in a repeat that passes over MD threads 10–11, between threads 12–13, over threads 14 and 15, between pairs of threads 16–17, 18–19, under threads 20–21 and between pairs of threads 22–23, 24–25.

With reference to FIG. 4, the second thread 51 is woven in a mirror image to the thread 50. Thus, CMD thread 51 weaves in a repeat that passes between the pair of threads 10–11, beneath the threads of pair 12–13, between the pairs 14–15, 16–17, over the threads of pair 18–19, between threads 20 and 21, over the threads of pair 22–23, and between threads 24–25.

Figure 6:
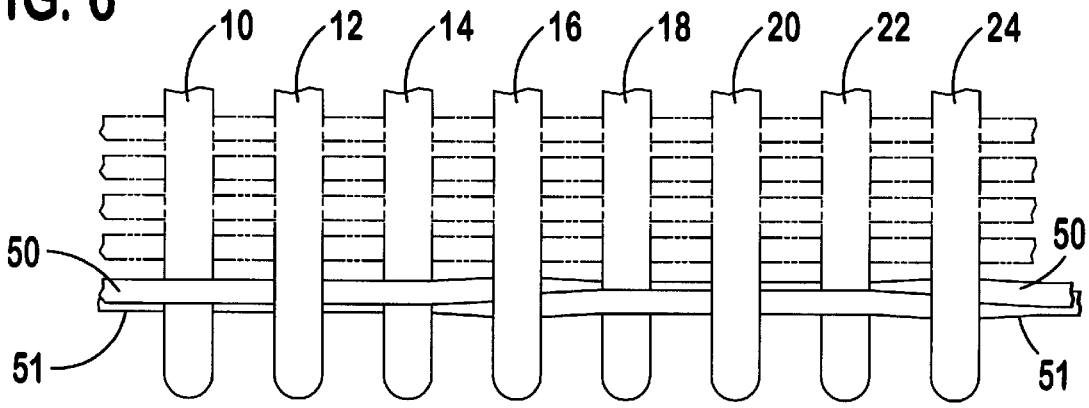
FIG. 6 is a top plan view of the combined weave patterns as illustrated in FIGS. 1, 2 and 5.

As can be seen from FIG. 5, two threads woven in accordance with FIGS. 3 and 4 produce a weave repeat structure having two crossover points 53 and 54 which are spaced apart by at least three MD threads. It will also be noted that MD thread 16 passes over both additional threads 50 and 51. Since the repeat pattern extends over eight pairs of MD threads with only a single interlacing in the machine side MD layer and the threads can shift beneath thread 16, threads 50 and 51 tend to act as one. As a result of the long transition and the spaced crossovers, the threads 50 and 51 can migrate relative to each other so that the resulting sheet side MD and CMD weave repeat appears to be a plain weave. This result is illustrated in FIG. 6 where the thread migration results in what appears to be a single thread structure.

Figure 7:
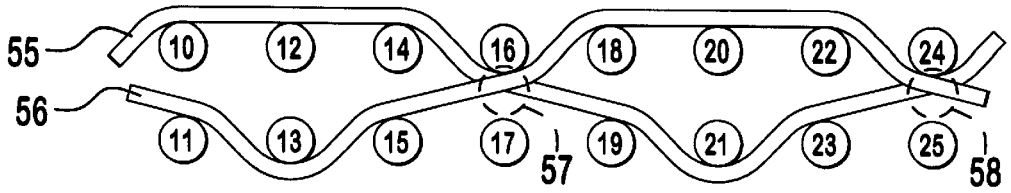
FIG. 7 illustrates the weave repeats for a second embodiment.
Figure 8:
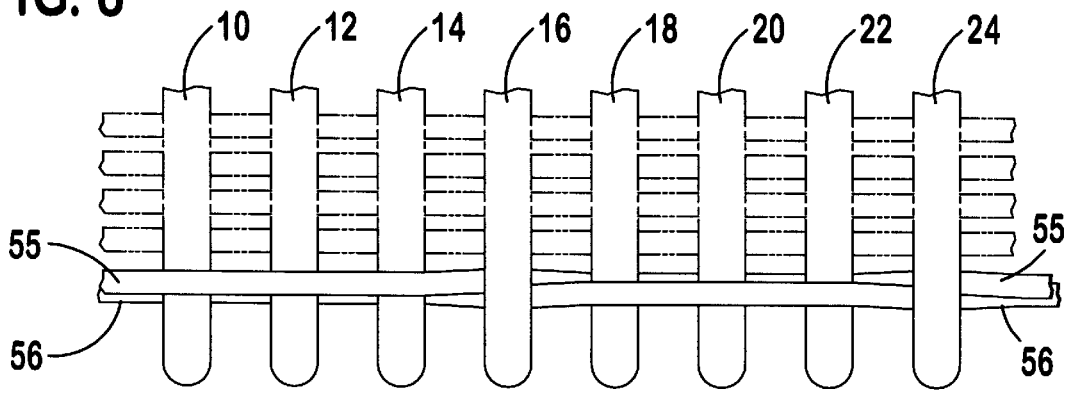
FIG. 8 a top plan view of the embodiment shown in FIG. 7.

With reference to FIG. 7, there is shown a second embodiment in a manner similar to that of FIG. 5. In this second embodiment, weave repeats of the CMD threads 55 and 56 result in floats over three machine direction threads 10, 12 and 14 and over three machine direction threads 18, 20, and 22. The long transition between pairs of machine direction threads and the interlacing with a single machine side MD thread per repeat is as previously described. This embodiment's crossover points 57 and 58 are also spaced apart by three MD threads; however, it also has two MD threads 16 and 24 that pass over, without interweaving, the intersection or crossover points of threads 55 and 56. Thus, the threads 50 and 51 will migrate relative to each other and produce relatively large, in-line sheet side floats. FIG. 8 illustrates the migration of threads 55 and 56 in a manner similar to that described with respect to FIG. 6.

Figure 9:
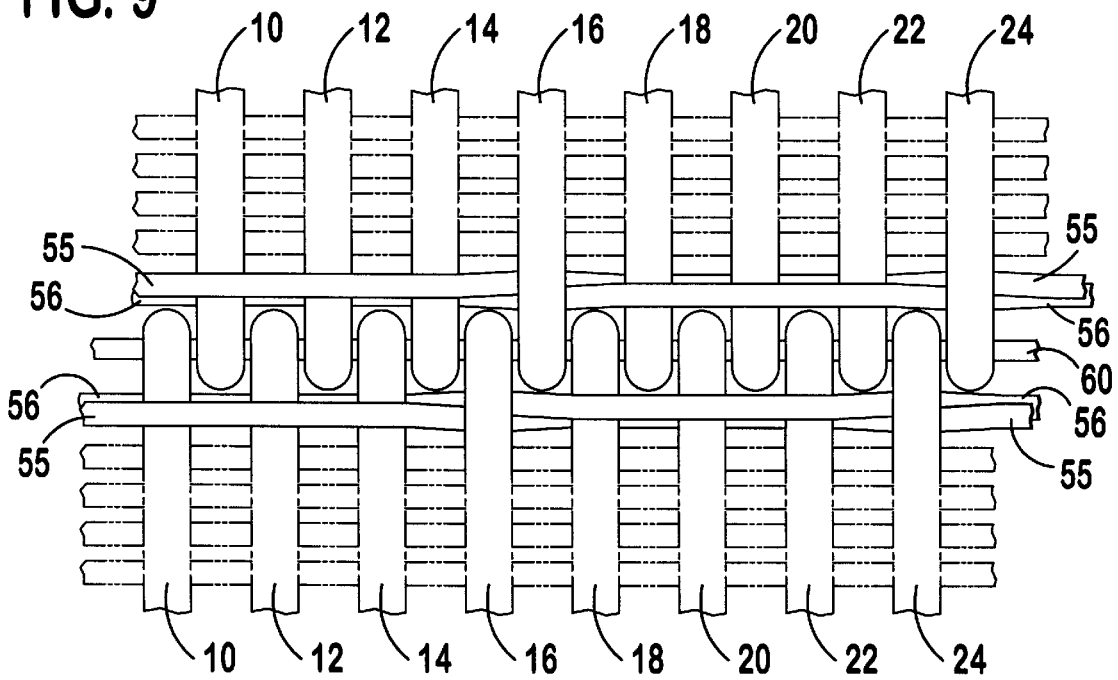
FIG. 9 illustrates a closed seam in accordance with the present invention.

FIG. 9 illustrates two ends of the fabric of the present invention joined by pintle 60. The additional threads 55 and 56 at each end of the fabric provide increased surface contact for better batt adhesion in the seam zone.

Figure 10:
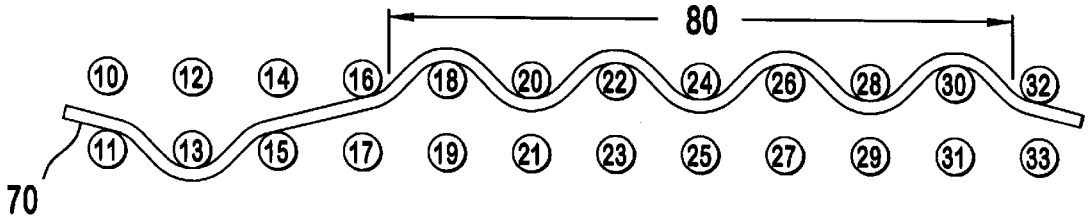
FIG. 10 illustrates the weave repeat for one additional thread in accordance with a third embodiment of the present invention.
Figure 11:
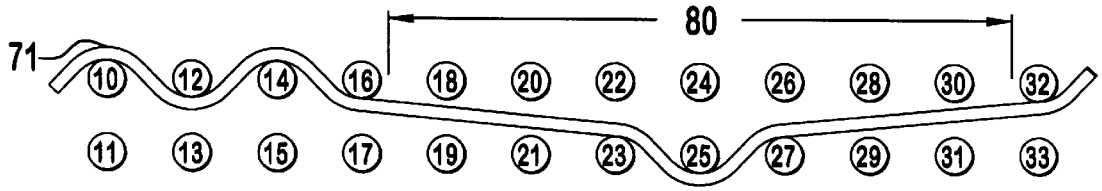
FIG. 11 illustrates the weave repeat for a second additional thread in accordance with the third embodiment.
Figure 12:
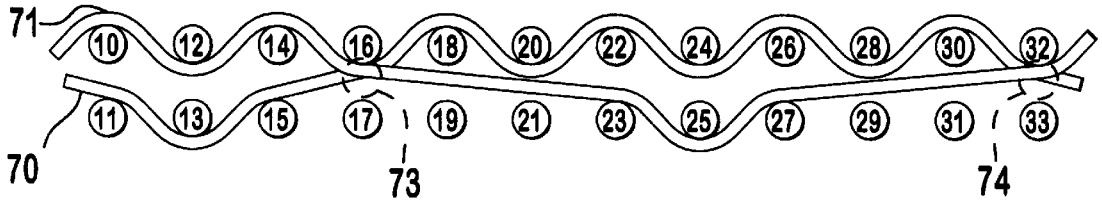
FIG. 12 shows the weave repeats of FIGS. 10 and 11 in combination.

A third embodiment of the present invention is shown in FIGS. 10–12. The fabric of this embodiment repeats on twenty four MD threads 10–33. The two additional threads 70 and 71 are interwoven in the seam zone 40 with both layers of longitudinal threads 10 through 33. Additional CMD thread 70 weaves in a repeat pattern that passes between MD threads 10–11, under MD threads 12–13, between MD thread pairs 14–15, 16–17, and then weaves a continuous portion of plain weave with top layer MD threads 18, 20, 22, 24, 26, 28,30 before transitioning down between MD threads 32–33. With reference to FIG. 11, the second additional thread 71 is woven in a complementary pattern to that of thread 70. Additional thread 71 weaves a plain weave construction with top layer threads 10, 12, 14 before transitioning into a mid-plane float between MD thread pairs 16–17, 18–19 , 20–21 , 22–23, weaving under MD threads 24–25 and transitioning back to a mid-plane float beneath thread pairs 26–27, 28–29, 30–31, 32–33.

As can be seen from FIG. 12, two additional threads interwoven in accordance with FIGS. 10 and 11 produce a weave repeat structure having the appearance of a plain weave in the upper layer and two crossover points 73 and 74 which are spaced apart by at least three MD thread pairs. This results from the additional longitudinal thread being in a continuous portion 80 of the weave repeat with seven adjacent MD threads between transitions from the machine or paper side longitudinal threads. Since the repeat pattern extends over twelve pairs of MD threads with only a single interlacing in the machine side MD layer and spaced apart crossover points, the additional threads can shift relative to each other and threads 70 and 71 tend to act as one thread in a continuous plain weave on the top layer. As a result of the long transitions, the interlacing patterns and the spaced crossover points, the additional threads can migrate relative to each other to produce the desired sheet side weave pattern while also providing mid-plane floats and long transitions.

Figure 13:
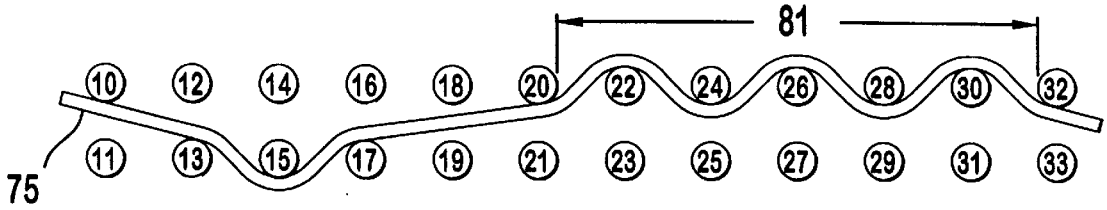
FIG. 13 illustrates the weave repeat for one additional thread in accordance with a fourth embodiment of the present invention.
Figure 14:
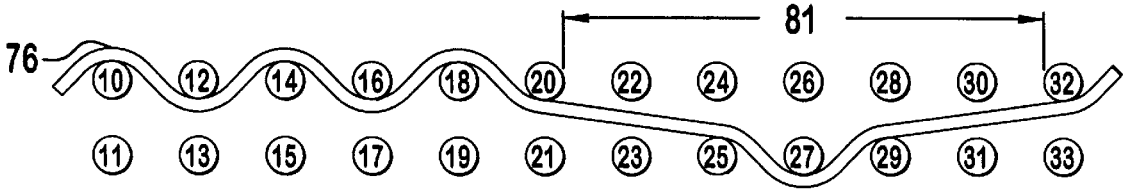
FIG. 14 illustrates the weave repeat for a second additional thread in accordance with the fourth embodiment.
Figure 15:
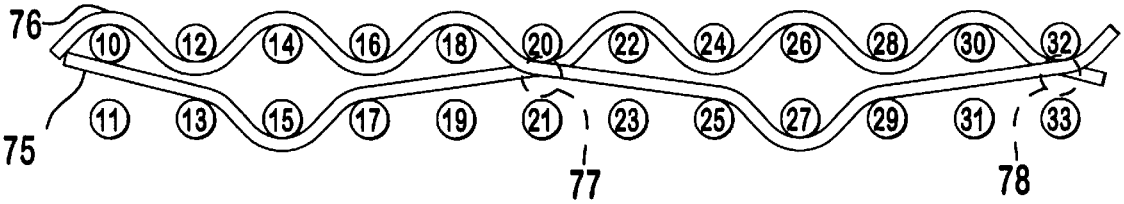
FIG. 15 shows the weave repeats of FIGS. 13 and 14 in combination.

With reference to FIGS. 13–15, there is shown a fourth embodiment of the present invention. In this fourth embodiment, the first additional thread 75 weaves between MD thread pairs 10–11, 12–13, beneath MD threads 14–15, between MD thread pairs 16–17, 18–19, 20–21, and then in a plain weave repeat with the upper layer MD threads 24, 26, 28, 30, 32. The second additional thread 76 weaves in the mirror image of thread 75. As shown by FIG. 15, the threads 75 and 76 produce a plain weave pattern on the paper sheet side, relatively long transitions which combine to simulate a mid-plane float and cross over points 77, 78 which are spaced by five MD thread pairs. This encourages migration of the threads 75, 76 relative to each other. As with the prior embodiment, this embodiment provides a continuous portion 81 of the weave repeat that extends over at least five adjacent paper side longitudinal threads between transitions from the machine or paper side longitudinal threads.

Figure 16:
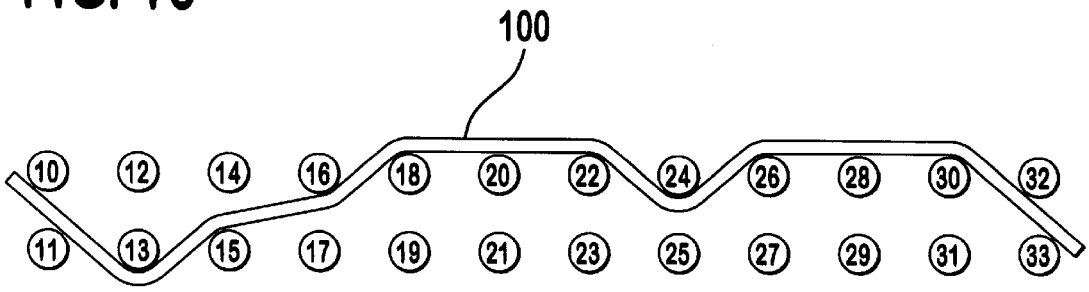
FIG. 16 illustrates the weave repeat for one additional thread in accordance with a fifth embodiment of the present invention.
Figure 17:
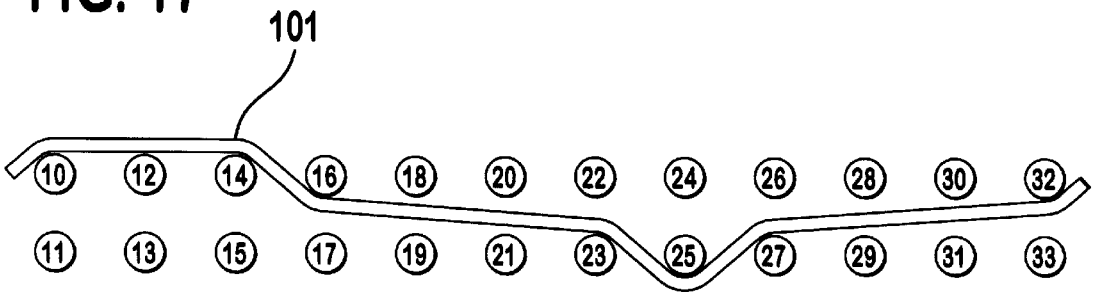
FIG. 17 illustrates the weave repeat for a second additional thread in accordance with the fifth embodiment.
Figure 18:
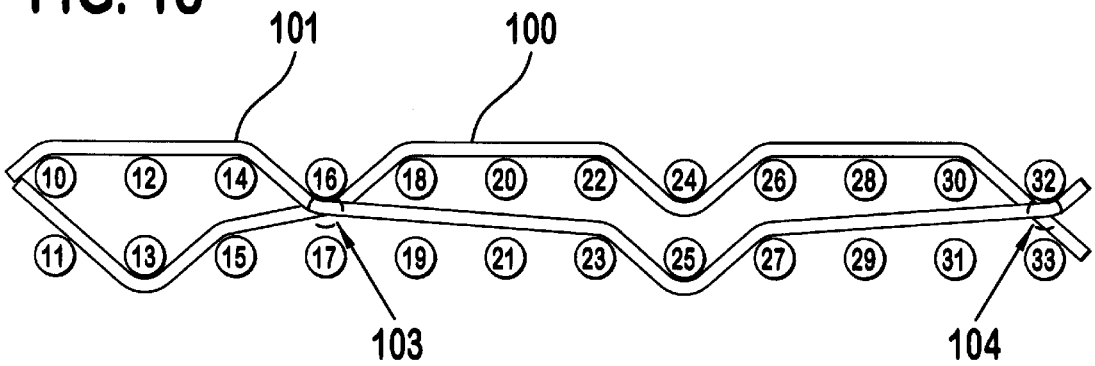
FIG. 18 shows the weave repeats of FIGS. 16 and 17 in combination.

Referring to FIGS. 16–18, a fifth embodiment is shown. Additional CMD thread 100 weaves in a repeat pattern that passes between MD threads 10–11, under MD threads 12–13, between MD thread pairs 14–15, 16–17, floats over MD threads 18–23, between MD threads 24–25, floats over MD threads 26–31 and between MD threads 32–33. With reference to FIG. 17, the second additional thread 101 is woven in a complementary weave pattern to that of thread 100. Additional thread 101 weaves over MD threads 10–15, between MD thread pairs 16–17, 18–19, 20–21, 22–23, under MD threads 24–25 and between MD thread pairs 26–27, 28–29, 30–31, 32–33. It will be noted from FIG. 17 that additional thread 101 forms two mid-plane floats between four pairs of MD threads 16–17, 18–19, 20–21, 22–23 and 26–27, 28–29, 30–31, 32–33.

As can be seen from FIG. 18, the two additional threads 100, 101 as interwoven in FIGS. 16 and 17 produce a weave repeat structure having the appearance of an over three, under one repeat in the upper layer. The two crossover points, 103, 104 are spaced apart by at least three MD thread pairs. This creates a long continuous portion of the second additional thread 101 which generally forms mid-plane floats that complement the long transition of the first additional thread 100. Since the repeat pattern extends over twelve pairs of MD threads with only a single interlacing in the machine side MD layer and spaced apart crossover points, and the additional threads can shift relative to each other and threads 100 and 101 tend to act as one thread in a continuous over three, under one weave pattern on the top layer. With reference again to FIG. 16 and additional thread 100, it can be seen that the weave repeat of thread 100 includes a subrepeat of three over one under which repeats twice within the pattern. This weave repeat permits the relatively loose interlacing of the thread 101 but enables the pattern to be continued throughout the upper layer when the threads 100, 101 are combined in accordance with FIG. 18.

Figure 19:
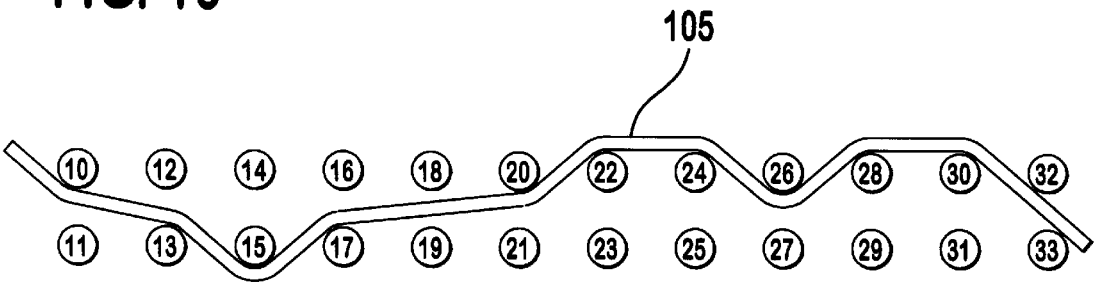
FIG. 19 illustrates the weave repeat for one additional thread in accordance with a sixth embodiment of the present invention.
Figure 20:
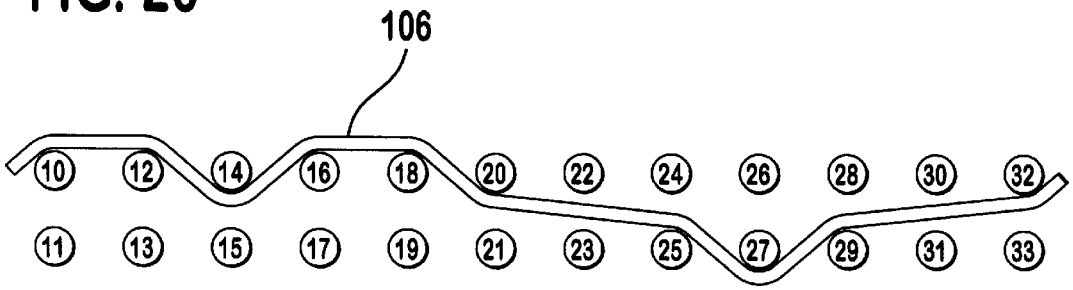
FIG. 20 illustrates the weave repeat for a second additional thread in accordance with the sixth embodiment.
Figure 21:
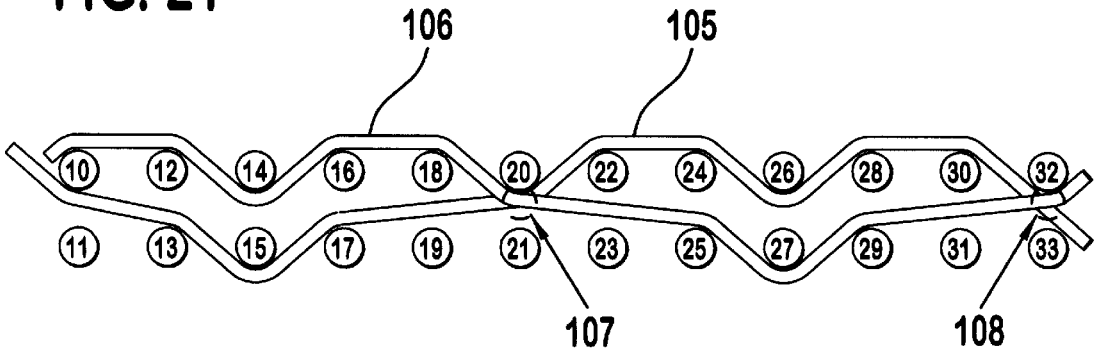
FIG. 21 shows the weave repeats of FIGS. 19 and 20 in combination.

With reference to FIGS. 19–21, there is shown a sixth embodiment of the present invention. In this sixth embodiment, the first additional thread 105 weaves between MD thread pairs 10–11, 12–13, beneath MD threads 14–15, between MD thread pairs 16–17, 18–19, 20–21, and then in two repeats of the subrepeat pattern of over two, under one with upper MD threads 22, 24, 26, 28, 30, 32.

The second additional thread 106 weaves in the mirror image of thread 105. As shown by FIG. 21, the threads 105 and 106 produce a two over, one under weave pattern on the paper sheet side, relatively long transitions which combine to simulate continuous floats in the mid-plane and crossover points 107,108 which are spaced apart by five MD thread pairs. This encourages migration of the threads relative to each other. As with the prior embodiment, this embodiment provides a weave repeat that includes two repeats of the subrepeat in adjacent paper side longitudinal threads between the transitions from the machine or paper side longitudinal threads.

It will be appreciated that batt adhesion will be most improved on the sheet side surface but that some improvement in machine side surface adhesion will result from the presence of the interlacings and relatively long transitions.

The additional CMD threads 50, 51; 55, 56; 70, 71; 75, 76; 100, 101; and 105, 106 can be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. Threads may be made from polymeric resins selected from a group consisting of polyamide, polyurethanes, polyesters, polyaramids, polyimides, polyolefins, polyetherketones, polypropylenes, PET, PBT, PTT, phenolics, and copolymers thereof.

What is claimed is:

1. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

two additional transverse threads interwoven in at least one seam zone with the longitudinal thread system, each of the two additional threads woven in a repeat pattern that includes a first transition between first paired paper and machine side threads and a second transition between second paired paper and machine side threads, the first transitions define a first crossover point and the second transitions define a second crossover point, the first and second crossover points separated are in the transverse direction by at least three top layer longitudinal threads.

2. The fabric of claim 1 wherein the crossover points are separated in the transverse direction by at least five top layer longitudinal threads.

3. The fabric of claim 1 wherein the additional threads migrate relative to one another such that a portion of one of the additional threads overlies a portion of the other additional thread.

4. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

at least one additional transverse thread interwoven in at least one seam zone with the longitudinal thread system in a repeat pattern that includes at least twelve adjacent paper side longitudinal threads, at least one machine side interlacing and a portion that weaves continuously with at least five adjacent paper side longitudinal threads.

5. The fabric of claim 4 wherein the portion that weaves continuously with at least five adjacent paper side longitudinal threads weaves with those threads in a plain weave pattern.

6. The fabric of claim 4 wherein the portion that weaves continuously with at least five adjacent paper side longitudinal threads weaves with those threads in a repeated pattern of over two and under one.

7. The fabric of claim 4 wherein the portion that weaves continuously with at least five adjacent paper side longitudinal threads weaves with those threads in a repeated pattern of over three and under one.

8. The fabric of claim 4 further characterized by a second additional transverse thread interwoven in the at least one seam zone with the longitudinal thread system in a repeat pattern that complements the first additional thread with the result that the combined paper side weave pattern of the additional threads is a continuous pattern across the repeat.

9. The fabric of claim 8 wherein the continuous paper side weave pattern across the repeat is a plain weave pattern.

10. The fabric of claim 8 wherein the continuous paper side weave pattern across the repeat is a repeated pattern of over two and under one.

11. The fabric of claim 8 wherein the continuous paper side weave pattern across the repeat is a repeated pattern of over three and under one.

12. The fabric of claim 8 wherein the additional threads migrate relative to one another such that a portion of one of the additional threads overlies a portion of the other additional thread.

13. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

at least one additional transverse thread interwoven with the longitudinal thread system in at least one seam zone in a repeat pattern that includes at least twelve adjacent paper side longitudinal threads, at least one machine side interlacing and a portion that weaves continuously with at least six adjacent paper side longitudinal threads and includes at least two identical subrepeats.

14. The fabric of claim 13 wherein each subrepeat is a pattern of over two and under one.

15. The fabric of claim 13 wherein each subrepeat is a pattern of over three and under one.

16. The fabric of claim 13 further characterized by a second additional transverse thread interwoven with the longitudinal thread system in the at least one seam zone in a repeat pattern that complements the first additional thread with the result that the combined paper side weave pattern of the two additional threads is a continuous weave including at least three of the subrepeats.

17. The fabric of claim 16 wherein each subrepeat is a pattern of over two and under one.

18. The fabric of claim 16 wherein each subrepeat is a pattern of over three and under one.

19. The fabric of claim 16 wherein the additional threads migrate relative to one another such that a portion of one of the additional threads overlies a portion of the other additional thread.

20. A method of producing a papermaker's fabric comprising the steps of:

interweaving a longitudinal thread system with a transverse thread system to define a base fabric having first and second ends and a paper side and a machine side;

forming a plurality of seam loops at each end of the fabric from the threads of the longitudinal thread system and defining a seam zone at each end of said fabric between the respective seam loops and a respective end thread of said transverse thread system; and interweaving at least one additional transverse thread in at least one seam zone with the longitudinal thread system in a repeat pattern that involves at least twelve adjacent paper side longitudinal threads, at least one machine side interlacing and a continuous portion of interweaving with at least five adjacent paper side longitudinal threads.

21. The method of claim 20 further comprising the step of interweaving a second additional transverse thread in the at least one seam zone with the longitudinal thread system in a repeat pattern that complements the first additional thread with the result that the combined paper side weave pattern of the additional threads is a continuous pattern across the repeat.

* * * * *